United States Patent [19]

Marti et al.

[11] 4,031,946

[45] June 28, 1977

[54] METHOD AND APPARATUS FOR CHANGING THE SECONDARY COOLING DURING CONTINUOUS CASTING OF STEEL

[75] Inventors: Heinrich Marti, Forch; Andreas Zogg, Zug; Oskar Hardegger, Hirzel, all of Switzerland

[73] Assignee: Concast AG, Zurich, Switzerland

[22] Filed: Feb. 20, 1975

[21] Appl. No.: 551,103

[30] Foreign Application Priority Data

Feb. 28, 1974 Switzerland ..... 2815/74

[52] U.S. Cl. ..... 164/89; 164/283 S

[51] Int. Cl.[2] ..... B22D 11/124

[58] Field of Search ..... 164/89, 283 S, 348, 164/283 R, 82; 239/165, 166, 587; 118/323, 314, 315; 266/45, 65, 113, 114, 115, 259; 72/201

[56] References Cited

UNITED STATES PATENTS

| | | | |
|---|---|---|---|
| 1,910,674 | 5/1933 | Bramsen et al. | 266/65 |
| 3,468,362 | 9/1969 | Burkhardt et al. | 164/283 S X |
| 3,561,398 | 2/1971 | Rose et al. | 118/323 X |
| 3,935,896 | 2/1976 | Tegtmeier et al. | 164/89 |

*Primary Examiner*—Ronald J. Shore
*Assistant Examiner*—Gus T. Hampilos
*Attorney, Agent, or Firm*—Werner W. Kleeman

[57] ABSTRACT

A method of and apparatus for changing the secondary cooling during continuous casting of steel, especially when changing the shape or format, wherein the strand surface is impinged by cooling agent jets produced by means of spray nozzles, the impingement of the cooling agent jets being in a direction transverse to the direction of travel of the cast strand. Upon changing the format of the strand to be cast there is altered the perpendicular distance of the nozzles from the strand surface and thus the cooling. According to the invention upon changing this distance and/or the spray angle of at least two nozzles located adjacent one another and transversely with respect to the strand, the mutual deviations of the impinged surfaces at the strand brought about by such change and the thus brought about change in the cooling are compensated by adjusting the distance between the nozzles.

9 Claims, 3 Drawing Figures

METHOD AND APPARATUS FOR CHANGING THE SECONDARY COOLING DURING CONTINUOUS CASTING OF STEEL

BACKGROUND OF THE INVENTION

The present invention relates to a new and improved method for changing the secondary cooling during the continuous casting of metals, typically steel, especially upon changing the section or format, wherein the strand surface is impinged by jets of cooling agent transverse to the strand and which cooling agent jets are produced by spray nozzles, and upon changing of the format the perpendicular distance of the nozzles from the strand surface is altered and thereby the cooling, and this invention also pertains to a new and improved construction of apparatus for the performance of the aforesaid method.

During the continuous casting of steel the strand emanating from the continuous casting mold is directly impinged with cooling agent in the thereafter following cooling zones. The cooling agent or medium, which is usually water, is sprayed by means of spray nozzles upon the strand surface, the nozzles being arranged in spray planes located generally perpendicular to the direction of travel of the cast strand.

At an overwhelming number of continuous casting installations a number of sections or formats are cast at the same installation. In order to accommodate the secondary cooling to the different strand widths and the different qualities of strands which are to be cast, it is already known to the art to shutdown individual nozzles or nozzle groups. This shutting-down of nozzles during the operation is associated with the drawback of calcification of the nozzle openings owing to the action of the heat, leading to irregularities in the cooling when such nozzles are again switched-on.

According to another prior art cooling apparatus one nozzle is arranged in each spraying plane per strand side. This nozzle is constructed such that the strand surface impinged by the cooling agent extends over the entire width of the strand. If the shape or format, i.e. the cross-sectional dimensions of the strand are changed, then the spacing of the individual nozzles with respect to the strand side is adjusted such that the impinged strand surface again covers the entire strand width. When increasing the strand dimension the nozzle must be moved away from the strand and when reducing the strand dimension the nozzle must be moved towards the strand. Appropriate devices are provided for altering the perpendicular distance of the nozzle from the strand surface. The use of nozzles possessing different spray characteristics should thus render possible the accommodation to different cooling conditions and insure for a uniform cooling over the entire strand width.

In order to be able to spray the entire strand width by means of a single spray nozzle, the spacing of this nozzle from the strand surface, especially in the case of very wide slabs, must be chosen to be large. This large spacing requires a high pressure of the coolant or cooling agent in the infeed line leading to the nozzle. Nonetheless the average impact pressure of the cooling agent at the strand surface is relatively small due to the great distance from the nozzle to the surface of the strand. Since with decreasing impact pressure the cooling effect or action is likewise reduced this constitutes a considerable drawback. Normally, the cooling agent is introduced into the intermediate spaces between the guide elements, for instance the strand guide rolls, so as to impinge upon the strand surface. A part of the cooling water runs-off in the form of water droplets over such guide elements especially at the vertical portion of the cooling zone. Since the nozzles are located externally of the guide elements owing to their large spacing from the strand surface, the cooling agent jet, i.e., the spray fan or jet, is considerably disturbed by the water droplets which are flowing off. In the case of a strand width in the order of for instance 2400 millimeters, the spacing between the guide rollers only amounts to about 40 millimeters, so that the nozzles must be fabricated with extreme accuracy in order to produce a spray fan or jet which permits the coolant to pass exactly between the rollers. Also stringent requirements are placed upon the alignment accuracy of the nozzles, because otherwise the spray jets partially, and in some instances, entirely impinge upon the guide rollers instead of upon the surface of the strand. In these instances it is impossible to obtain uniform cooling over the entire strand width.

A further accommodation of the cooling, especially for metallurgical reasons, can be realized by changing the pressure in the infeed lines or conduits leading to the nozzles. Such pressure changes bring about changes in the angle of the spray pattern or spray jet, resulting in undesired changes in the size of the impinged surface at the strand and thus the cooling action.

SUMMARY OF THE INVENTION

Hence, it is a primary object of the present invention to provide an improved method of, and apparatus for, changing the secondary cooling during continuous casting of metals, especially steel, in a manner not associated with the aforementioned drawbacks and limitations of the prior art proposals.

It is another and more specific object of this invention to provide an improved method of and apparatus for changing the secondary cooling during the continuous casting of steel, and specifically, rendering possible a universal and reliable accommodation of the cooling action upon change in the format or section of the cast strand, change in the composition of the steel or changes in the spray angle.

Now in order to implement these and still further objects of the invention, which will become more readily apparent as the description proceeds, the method aspects of this development contemplate that upon changing the distance and/or the spray angle of at least two adjacently situated nozzles arranged transversely with respect to the strand, the mutal deviations of the impinged surfaces at the strand which are brought about by such changes and the thereby brought about change in the cooling are compensated by adjusting the distance between the nozzles.

This technique renders possible a universal accommodation of the cooling to the changing conditions upon change in the format and change in the composition of the steel. The region of the surface sprayed by each nozzle can be accommodated to the momentary requirements. Upon changing the water pressure it is possible to correct the thereby brought about changes in the angle of the spray pattern or jet and the size of the sprayed surfaces and the thus resulting changes of the cooling. It is unnecessary to shutdown individual nozzles or nozzle groups for accommodating the different strand widths and hence there can be avoided the previously mentioned drawbacks of nozzle clogging. Moreover, there is realized a reduction in both the costs of the installation and the operating costs, because there can be used movable nozzles, whereby the spacing of the nozzles with respect to the strand surface considerably reduces. Consequently, there results a reduction of the coolant pressure in the infeed lines. The water quantity can be optimumly adjusted, resulting in a saving in the economies of the cooling process. There can be avoided spraying over the edges. At the lower region of the secondary cooling zone, depending upon requirements, there can be sprayed also only a part of the slab width, because the edge regions are oftentimes sufficiently cooled-off. Due to the lesser spacing of the nozzles from the strand such are exposed to the protective action of the guide elements, so that the spray patterns or jets are no longer disturbed by dripping water droplets.

It is advantageous, when at least two nozzles per spray plane of a strand side, the dimensions of which are changed, are adjusted at an inclination to the strand in a plane which is perpendicular to the direction of travel of the strand. A further advantage resides in the fact that upon adjusting the relationship of a strand side dimension to the corresponding perpendicular distance of the nozzles from the strand surface and the strand side dimension to the corresponding distance between the nozzles it is possible in each case to make the setting at a constant value.

An additional advantage is realized if the pressure of the coolant in front of the nozzle is maintained constant. With increasing casting format generally the casting speed is reduced and vice versa. With reduced casting speed less heat must be removed per strand surface element and unit of time, that is to say, the coolant impingement per surface element and unit of time can likewise be reduced. It is possible to obtain a change of the specific coolant impingement by changing the spacing or distance of the nozzle from the surface. If there is selected a suitable average or mean value for the pressure of the coolant i.e., the flow of coolant through the nozzle, then it is possible to adjust the change of the specific coolant impingement upon change in the format by altering the spacing of the nozzle from the strand surface.

Not only is the invention concerned with the aforementioned method aspects but also deals with apparatus for carrying out the method of this invention. A particularly suitable constructional manifestation of apparatus for the performance of the inventive method is manifested by the features that there are provided at least at one strand side at least two displaceable nozzles per side and spray plane with positioning devices, and there is adjustable the spacing of such nozzles to the strand surface and at the same time the spacing between these nozzles.

Advantageously, the apparatus is constructed such that the operating positions of the adjustable nozzles are each located at a straight line which is determined by the point of intersection of the central perpendicular at the relevant strand side with the surface of such side and the outermost operating position of the relevant nozzles.

A further solution can be realized when the operating positions of the adjustable nozzles are located upon a respective straight line which is determined by a corner of the strand cross-section and the outermost operating position of the relevant nozzle.

Furthermore, the adjustment of the nozzles can occur in that the adjustable nozzles of a respective group are connected with one another through the agency of a hinge or pivot mechanism which defines a lever system, one location of the lever system is connected with a drive and for each nozzle there is provided a guide or guide means.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
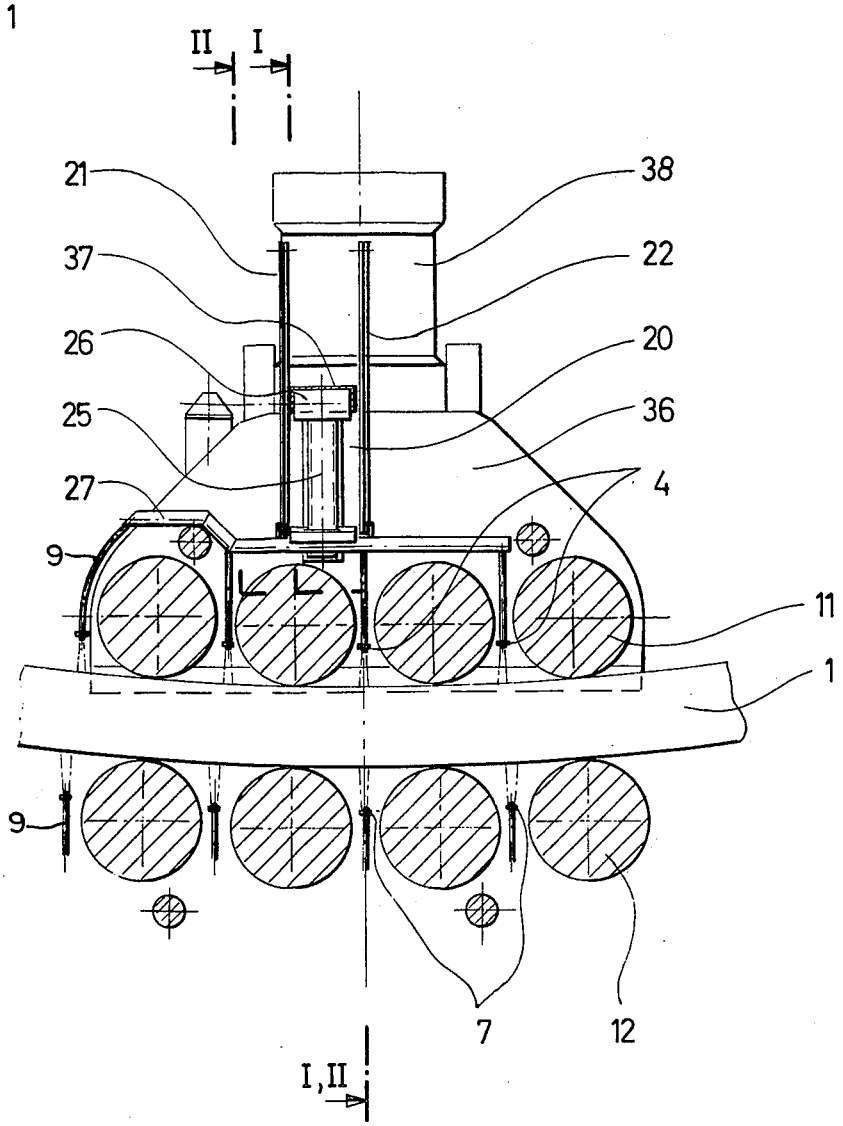
FIG. 1 is a sectional view through a strand guide segment taken along the strand axis.

Describing now the drawings, in FIG. 1 there is illustrated a continuously cast strand 1 which travels through a strand guide segment 38 of a continuous casting installation or plant. For the sake of clarity in illustration only enough of the continuous casting installation has been shown to enable those skilled in the art to readily understand the underlying concepts of the invention. Continuing, it will be recognized that this strand 1 is guided and supported by the rollers or rolls 11, 12. For the purpose of cooling the throughpassing strand 1, a cooling agent or coolant, for example water, is applied to the strand 1 by means of the spray nozzles 4 and 7. In front of and behind the nozzles 4 and 7 shown in FIG. 1 there is arranged further nozzle rows 3, 5, 6 and 8 which are not visible in FIG. 1 but shown in FIG. 2. The nozzles 4 and 7 can be individually arranged or assembled together into groups, as such is shown in FIG. 1. At the upper strand side or surface there are assembled together four nozzles 4 into a group and at the lower strand side or surface four nozzles 7 into a group. The nozzles 4 are secured by means of nozzle tubes or pipes 9 at a nozzle carrier or support 27 which is part of a nozzle adjustment device or mechanism 20, and connected via an adjustment mechanism 25, 26 and a mechanism 21 as well as guides with a bracing support or carrier 37. The support or carrier 37 in turn is secured to the side walls 35, 36 of the segment 38. In order to simplify the showing of the drawings the nozzle adjustment device 20 has only been illustrated for the upper strand surface or side. It is to be understood however that an identical arrangement is also located at the lower surface or side of the strand. The guide segment 38 is adjustable to different strand thicknesses in that the upper segment portion with the rollers 11 can be hydraulically raised or lowered by means of a suitable hydraulic lifting mechanism. Since the adjustment device or mechanism 20 for the nozzles 4 is connected via the support 37 with the side walls 35, 36 of the upper segment portion, the nozzles 4 are simultaneously adjusted along with the rollers 11 and therefore do not change their spacing with respect to the strand surface when carrying out an adjustment for different thicknesses of the strand.

Figure 2:
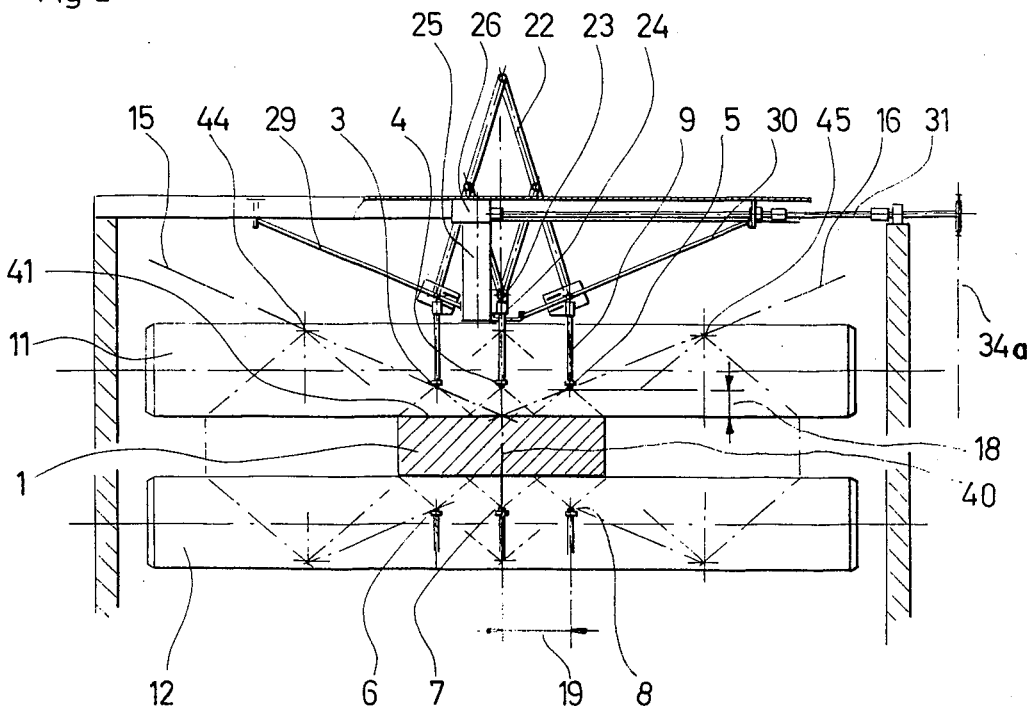
FIG. 2 is a partial sectional view in a direction transverse to the direction of travel of the strand, taken along the line I—I of FIG. 1, depicting the adjustment mechanism for the nozzles of a narrow slab.

The adjustment device or mechanism 20 for changing the distance or spacing of the nozzles 3 to 8 has been illustrated in FIG. 2. As far as the guide segment 38 is concerned there has only been shown in such Figure the components or parts which are important for the adjustment device 20. In the illustrated example the strand 1 is cast so as to have a smaller width, for instance amounting to 700 millimeters. The nozzles 3, 4 and 5 are arranged in a plane which is disposed approximately perpendicular to the direction of travel of the strand in such a manner that the entire width of the strand is sprayed. If for a desired strand width there is known the number of nozzles and the spray angle of the spray pattern or fan, then there can be determined the distance or spacing 18 of the nozzles 3, 4 and 5 from the strand surface 41 as well as the spacing or distance 19 between the nozzles. The same also holds true for the nozzles 6, 7 and 8. For the smallest strand width to be sprayed there thus are given the positions of the nozzles, as such has been shown in FIG. 2. The nozzles 3, 4 and 5 are connected through the agency of nozzle pipes 9 with the nozzle holders 32, 33 and 34 which have been shown in FIG. 3. These nozzle holders 32, 33, 34 are components or parts of the nozzle supports or carriers 27 shown in FIG. 1 and in the described example three such supports 27 are located adjacent one another transverse to the strand. The nozzle supports 27 and thus the nozzle holders 32, 33 and 34 are connected with one another through the agency of a hinge or pivot mechanism 21, 22 defining a lever system, in such a manner that the nozzles of one group can be collectively shifted from one operating position into another. In the exemplary embodiment under discussion the group at the upper strand surface encompasses twelve nozzles, each four of which exhibit identical displacement paths. For each strand side or surface and segment there is provided a nozzle adjustment device or mechanism 20 which encompasses the components 21, 22, 25, 26, 29, 30 and 31 as well as 27, 32, 33 and 34.

If at the continuous casting installation there are fabricated different strand shapes or formats, for instance also strands possessing greater widths, then also the cooling water must be applied over a greater width. In order to render this possible the spacing 18 of the nozzles from the strand surface and also the spacing 19 between the nozzles can be changed as soon as the width of the strand is altered. In so doing at least two nozzles per strand side and spray plane should be adjusted. In the exemplary embodiment under discussion there are adjusted in each instance three nozzles per spray plane and specifically at the upper side the nozzles 3, 4 and 5 and at the lower side the nozzles 6, 7 and 8, wherein in the direction of strand travel there are provided four spray planes per group.

In the case of three nozzles the intermediate nozzle 4 is adjusted along the central perpendicular to the wide side 41 of the strand 1. Both of the outer nozzles 3 and 5 are adjusted such that the relationship of the spacing 18 to the width of the strand always forms a constant value and also the relationship of the spacing 19 between the nozzles to the width of the strand remains constant. For this purpose the nozzle 3 is displaced along a straight line 15 and the nozzle 5 along a straight line 16. The displacement line 15 is defined, on the one hand, by the point of intersection of the central perpendicular 40 with the strand surface 41 and, on the other hand, by the operating position 44 of the nozzle 3 which is adjusted for the spraying of the widest strand. The displacement line 16 is analogously determined by the intersection point of the central perpendicular 40 with the strand surface 41 and the operating point 45.

In order to insure that all three nozzles per plane and side during the accommodation to changes in the format or section of the strand 1 alter their spacing 18 from the strand in the same relationship, and that also the relationship of the spacing 19 to the total strand width which is to be momentarily sprayed remains constant, the nozzles 3, 4 and 5 are connected with one another via the hinge or pivot mechanism 22. If the width of the strand is changed then the drive shaft 31 of the drive **34*a* is placed into rotation. This rotational movement is transmitted by the drive or gearing 26 to an adjustment spindle 25. Seated on this spindle is a nut member which is connected with the nozzle holder 33 or the intermediate nozzle carrier or support 27. The rotational movement of the spindle 25 thus produces a movement of the nozzle holder 33 which extends approximately perpendicular to the strand 1. Depending upon the rotational sense of the drive shaft 31 the nozzle holder 33 and at the same time also the nozzle holders 32, 34 move towards or away from the strand. At the same time the nozzles 3, 4 and 5 move since such are connected via the nozzle pipes or tubes 9 with the nozzle holders 32, 33, 34. At the nozzle pipes 9** there are connected conventional and therefore not particularly illustrated flexible cooling agent infeed lines or conduits.

The position or location 2 at the nozzle holder 33 constitutes the drive point for the mechanism 22. The individual lever lengths of this mechanism 22 are chosen such that the nozzle holders 32, 34 and the corresponding nozzle support 27 move along the guides 29 and 30. The guide 29 extends parallel to the displacement line 15 and the guide 30 parallel to the displacement line 16.

Figure 3:
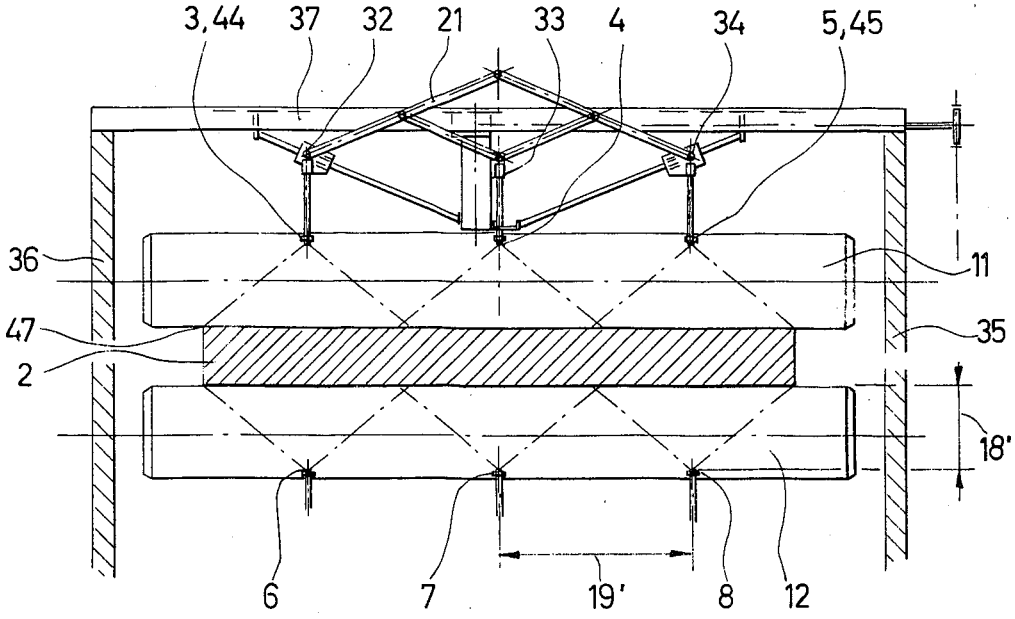
FIG. 3 is a partial sectional view in a direction transverse to the direction of travel of the strand, taken along the line II—II of FIG. 1, illustrating the adjustment mechanism for the nozzles of a wide slab.

FIG. 3 illustrates the position of the nozzle holders 32, 33 and 34 with the nozzles 3 to 8 when there is intended to be produced a wide strand. The strand width amounts to, for instance, 2000 millimeters. With the illustrated equipment and the described method it is possible to cool strands over a large dimensional range without the need to exchange nozzles or to turn-on and turn-off nozzles. Since the nozzles 3, 4 and 5 even in the outermost position, for instance positions 44 and 45, are still located between the rollers 11, the spray patterns or fans are not or only to a negligible degree disturbed by the sprayed water. The relationship of the distance or spacing 18' to the width of the strand 2 is equal to the relationship of the spacing or distance 18 to the width of the strand 1 of FIG. 1. The same is also true for the dimensions 19' and 19.

A further advantage resides in the fact that deviations of the impinged surface at the strand owing to changes in the pressure and the spray pattern angle can be likewise corrected. These deviations can be compensated by means of the described adjustment device. A slab with the dimensions of a large width according to FIG. 3 is generally cast at a lower casting speed than a narrow slab according to FIG. 2, resulting in the fact that per unit of time and surface element less cooling water must be applied.

With the described solution this reduction of the specific cooling water impingement occurs without change in the pressure and the throughflow quantity of cooling water in the nozzles 3 to 8. This is so because with increasing spacing of the nozzles 3 to 8 from the strand surface 41 there is reduced the quantity of water per unit of time and surface element which is applied to the strand surface. Consequently, there is provided a further simplification of the work upon changing the strand format or section. With unfavorable conditions upon changing the strand format the relationship of the water quantities per nozzle for different spacing from the strand surface should be equal to the relationship of the product of the strand width times the casting speed and which product corresponds to the momentary spacings.

With the previously discussed embodiments there was assumed that changes in the format always occurred symmetrically with respect to the strand axis. There are however possible also solutions wherein one of the corner points or corners of the strand, for instance the point 47 in FIG. 3, retains the same position for all formats. In this case the paths of movement of the nozzles 3, 4 and 5 are determined by straight lines which pass through the point 47 and the outermost operating positions of such nozzles. Upon changing the format of the strand the corner point 47 remains in its position and the width dimensions of the strand are changed starting from such point 47. This solution could be employed for instance when using divided molds (twin molds). In such case, for instance two strands are simultaneously cast at the same installation. Two nozzles are used per strand, sprayed strand side and spray plane, and which nozzles are connected with appropriately modified adjustment devices 20.

If there are cast strands 2 which are even wider than the strand illustrated in FIG. 3, then it is beneficial to employ four or five nozzles per side and plane. In this way it is possible to maintain as low as possible the water pressure in front of the nozzles without the impact pressure of the cooling water at the strand surface reducing.

While there is shown and described present preferred embodiments of the invention, it is to be distinctly understood that the invention is not limited thereto, but may be otherwise variously embodied and practiced within the scope of the following claims.

Accordingly, we claim:

1. A method of cooling a steel strand of substantially rectangular cross-section in the secondary cooling zone of a continuous casting machine, wherein spray nozzles having operating positions are arranged in a group of essentially parallel rows, each row comprising at least two spray nozzles, said rows extending transversely with respect to the direction of travel of the strand, the spray nozzles emitting cooling agent to form substantially adjoining cooling agent patterns on the strand surface, the improvement comprising the steps of: synchronously groupwise altering the distance of said nozzles from said strand surface and at the same time groupwise altering the distance between said nozzles of a row in dependency upon a change in the strand format, the distance of the nozzles of a row from the strand surface and between each other being altered such that the operating positions of each nozzle lie along a substantially straight line which intersects with the strand surface, whereby the cooling agent patterns on the strand surface remain in a substantially adjoining position with respect to each other.

2. The method as defined in claim 1, wherein upon changing the transverse dimension of one strand surface to be cooled owing to a change of strand format, at least two nozzles of one said row which spray said strand surface are moved in a plane perpendicular to the direction of travel of said strand and along a line inclined to said strand surface.

3. The method as defined in claim 2, wherein during the adjustment the relationship of the strand side dimension to the corresponding perpendicular distance of the nozzles from the strand surface and the strand side dimension to the corresponding distance between the nozzles are each adjusted to a constant value.

4. The method as defined in claim 1, including the step of maintaining constant the pressure of the cooling agent in front of the nozzles.

5. An apparatus for changing the secondary cooling of a continuously cast strand during the continuous casting of metals, especially steel, in particular upon changing the format of the cast strand, comprising a number of coolant spray nozzles operatively associated with the strand sides and located in spray planes, means for adjusting the perpendicular distance of the spray nozzles to the associated strand surface for the accommodation of said spray nozzles to different dimensions of the strand sides, the improvement comprising said spray nozzles including at least two displaceable spray nozzles at least at one strand side per strand side and spray plane, said displaceable spray nozzles having operating positions, said adjusting means including positioning means provided for said displaceable spray nozzles for synchronously adjusting the distance of said displaceable spray nozzles to the associated strand surface and at the same time the distance between said displaceable spray nozzles such that the operating positions of each of said displaceable spray nozzles lie along a substantially straight line which intersects with said associated strand surface.

6. The apparatus as defined in claim 5, wherein the operating positions of each of said displaceable spray nozzles are located upon a straight line which is determined by the intersection point of a central perpendicular at the associated strand side with the surface of such strand side and an outermost operating position of the spray nozzles associated with the corresponding straight line.

7. The apparatus as defined in claim 5, wherein the operating positions of the displaceable spray nozzles are located at a respective straight line which is determined by a corner of the strand cross-section and the outermost operating position of the spray nozzle associated with the corresponding straight line.

8. The apparatus as defined in claim 5, wherein the displaceable spray nozzles are assembled into a group, and the displaceable spray nozzles of each group are interconnected with one another via a hinge mechanism defining a lever system, one location of the lever system being connected with drive means, and a respective guide is provided for each displaceable spray nozzle.

9. An apparatus for changing the secondary cooling of a continuously cast strand during the continuous casting of metals, especially steel, in particular upon changing the format of the cast strand, comprising a number of coolant spray nozzles operatively associated with each strand side and located in spray planes, said coolant spray nozzles incorporating at least two displaceable spray nozzles at least at one strand side per strand side and spray plane, said displaceable spray nozzles having operating positions, means provided for said displaceable spray nozzles for synchronously adjusting the distance of said displaceable spray nozzles to the associated strand surface and at the same time the distance between said displaceable spray nozzles such that the operating positions of each of said displaceable spray nozzles lie along a substantially straight line which intersects with said associated strand surface.

* * * * *